US012807894B2

(12) United States Patent
Saito et al.

(10) Patent No.: US 12,807,894 B2
(45) Date of Patent: Nov. 24, 2026

(54) LUBRICATING OIL COMPOSITION FOR AGRICULTURAL MACHINES

(71) Applicant: Cosmo Oil Lubricants Co., Ltd., Tokyo (JP)

(72) Inventors: Takuma Saito, Saitama (JP); Naoki Asami, Saitama (JP)

(73) Assignee: Cosmo Oil Lubricants Co., Ltd., Tokyo (JP)

( * ) Notice: Subject to any disclaimer, the term of this patent is extended or adjusted under 35 U.S.C. 154(b) by 0 days.

(21) Appl. No.: 17/995,738

(22) PCT Filed: Apr. 14, 2020

(86) PCT No.: PCT/JP2020/016442

§ 371 (c)(1),
(2) Date: Oct. 7, 2022

(87) PCT Pub. No.: WO2021/210068

PCT Pub. Date: Oct. 21, 2021

(65) Prior Publication Data

US 2023/0159850 A1 May 25, 2023

(51) Int. Cl.

| | |
|---|---|
| ***C10M 169/04*** | (2006.01) |
| ***C10M 101/02*** | (2006.01) |
| ***C10M 145/14*** | (2006.01) |
| ***C10N 30/00*** | (2006.01) |
| ***C10N 30/02*** | (2006.01) |

(52) U.S. Cl.

CPC ..... *C10M 169/041* (2013.01); *C10M 101/02* (2013.01); *C10M 145/14* (2013.01); *C10M 2203/1006* (2013.01); *C10M 2209/084* (2013.01); *C10N 2030/02* (2013.01); *C10N 2030/68* (2020.05)

(58) Field of Classification Search

CPC ..... C10M 101/02; C10M 145/14; C10M 169/041; C10M 2203/1006; C10M 2209/084; C10M 169/044; C10M 2203/1025; C10M 2223/045; C10N 2030/02; C10N 2020/02; C10N 2020/04; C10N 2030/68

See application file for complete search history.

(56) References Cited

U.S. PATENT DOCUMENTS

| | | | | |
|---|---|---|---|---|
| 2004/0018946 | A1 | 1/2004 | Aoyagi et al. | |
| 2004/0102339 | A1 | 5/2004 | Aoyagi et al. | |
| 2004/0209787 | A1 | 10/2004 | Aoyagi et al. | |
| 2010/0144571 | A1 | 6/2010 | Shirahama et al. | |
| 2012/0172268 | A1 | 7/2012 | Shirahama et al. | |
| 2016/0040095 | A1* | 2/2016 | Fujii | C10M 145/14 508/463 |
| 2020/0032160 | A1* | 1/2020 | Komatsubara | C10M 145/14 |

FOREIGN PATENT DOCUMENTS

| | | | | |
|---|---|---|---|---|
| EP | 2395068 | A1 * | 12/2011 | C10M 169/041 |
| JP | H03-020396 | A | 1/1991 | |
| JP | 2004-059930 | A | 2/2004 | |
| JP | 2006-274209 | A | 10/2006 | |
| JP | 2008-308697 | A | 12/2008 | |
| JP | 2015172165 | A * | 10/2015 | |
| JP | 2018-177986 | A | 11/2018 | |
| WO | 2007/001000 | A1 | 1/2007 | |

OTHER PUBLICATIONS

English Translation of Written Opinion of the ISA issued in International Application No. PCT/JP2020/016442 on Jun. 23, 2020.
International Search Report issued in International Application No. PCT/JP2020/016442 on Jun. 23, 2020.
Written Opinion of the ISA issued in International Application No. PCT/JP2020/016442 on Jun. 23, 2020.

* cited by examiner

*Primary Examiner* — Latosha Hines
(74) *Attorney, Agent, or Firm* — Banner & Witcoff, Ltd.

(57) ABSTRACT

A lubricating oil composition for agricultural machines, containing: at least one base oil selected from the group consisting of mineral oil-based base oils and synthetic oil-based base oils; and a polyalkyl methacrylate-based viscosity index improver having a weight average molecular weight of from 20,000 to 80,000, in which a kinematic viscosity at 100 °C. is from 8.00 $mm^2/s$ to 10.00 $mm^2/s$, a kinematic viscosity reduction rate at 100 °C. in an ultrasonic shear stability test is 10.0% or less, and a Brookfield viscosity at −40 °C. is 20,000 mPa·s or less.

4 Claims, No Drawings

LUBRICATING OIL COMPOSITION FOR AGRICULTURAL MACHINES

RELATED APPLICATIONS

This application is a National Stage Application under 35 U.S.C. 371 of co-pending PCT application PCT/JP2020/016442 designating the United States and filed Apr. 14, 2020; which is hereby incorporated by reference in its entirety.

TECHNICAL FIELD

The present disclosure relates to a lubricating oil composition for agricultural machines.

BACKGROUND ART

Examples of the agricultural machine include a tractor as a ground leveling work machine, a rice transplanter as a raising management work machine, a binder or a combine as a harvesting work machine, and the tractor is most widely used.

The agricultural machine has many contact points between metals to which the lubricating oil composition is applied. For example, the tractor includes many contact points between metals in a hydraulic pump portion, a transmission device portion, a power take-off (PTO) clutch portion, a differential gear device portion, a wet brake portion, and the like. However, one type of lubricating oil composition is often used for these various contact points. Therefore, the lubricating oil composition for agricultural machines is required to have multifunctional roles such as friction characteristics, abrasion resistance, oxidation stability, rust prevention, and compatibility with organic materials.

In order to secure performance required for such agricultural machine applications and further improve the performance, a lubricating oil composition obtained by blending various additives according to desired performance with a selected base oil is currently supplied. For example, Japanese Patent Application Laid-Open No. H3-020396 discloses a lubricating oil composition in which a base oil contains a predetermined amount of an overbased sulfonate and an ethoxyphosphate.

Further, Japanese Patent Application Laid-Open No. 2004-059930 discloses a functional liquid to which an alkali metal or alkaline earth metal of a specific polyalkylene sulfonic acid is added, as a functional liquid to be used in a method for improving braking performance and clutch performance.

Since the agricultural machine is also used in cold regions in winter, as a lubricating oil composition focusing on use under low temperature conditions as well, a technique for increasing a viscosity index, reducing viscous resistance under low temperature, and improving low-temperature startability is disclosed.

For example, WO 2007/001000 A, Japanese Patent Application Laid-Open No. 2008-308697, Japanese Patent Application Laid-Open No. 2006-274209, and Japanese Patent Application Laid-Open No. 2015-172165 disclose that an additive such as a poly(meth)acrylate-based additive is contained in a base oil having a predetermined composition.

SUMMARY OF INVENTION

In recent years, with an increase in output of agricultural machines such as tractors, a load on a gear portion and the like has increased. Therefore, a lubricating oil composition applied to such agricultural machines is desired to have high shear stability in addition to extreme pressure properties.

In lubricating oil compositions, a poly(meth)acrylate-based additive having a high weight average molecular weight has been conventionally used as one measure for reducing viscous resistance at low temperature. However, a lubricating oil composition containing a poly(meth)acrylate-based additive having a high weight average molecular weight lacks shear stability, and in use in an actual machine, there are concerns about an increase in viscosity reduction that occurs when the lubricating oil composition is sheared by a gear and an increase in viscous resistance at low temperature. Therefore, the fact is that further improvement is required for lubricating oil compositions for agricultural machines, which have a wide variety of application sites and are also required to be used in cold regions and the like.

An object of an embodiment of the present disclosure is to provide a lubricating oil composition for agricultural machines capable of reducing viscous resistance at low temperature (for example, −40 °C. to 0 °C.) and having excellent shear stability.

The lubricating oil composition for agricultural machines of the present disclosure includes the following embodiments.

<1> A lubricating oil composition for agricultural machines, containing: at least one base oil selected from the group consisting of mineral oil-based base oils and synthetic oil-based base oils; and a polyalkyl methacrylate-based viscosity index improver having a weight average molecular weight of from 20,000 to 80,000, in which a kinematic viscosity at 100 °C. is from 8.00 $mm^2/s$ to 10.00 $mm^2/s$, a kinematic viscosity reduction rate at 100 °C. in an ultrasonic shear stability test is 10.0% or less, and a Brookfield viscosity at −40 °C. is 20,000 mPa·s or less.

<2> The lubricating oil composition for agricultural machines according to <1>, in which a content of the polyalkyl methacrylate-based viscosity index improver is from 10 mass % to 18 mass % with respect to a total amount of the composition.

<3> The lubricating oil composition for agricultural machines according to <1> or <2>, in which the polyalkyl methacrylate-based viscosity index improver is a polyalkyl methacrylate having a constituent unit represented by the following formula (Ia) and a constituent unit represented by the following formula (Ib).

(Ia)

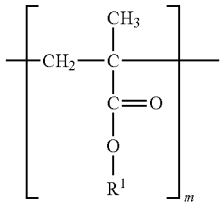

(Ib)

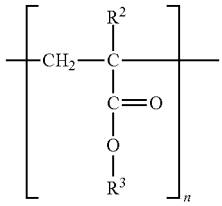

Wherein, in formulae (Ia) and (Ib), $R^1$ represents a hydrogen atom or an alkyl group having from 1 to 24 carbon atoms, $R^2$ represents a hydrogen atom or a methyl group, $R^3$ represents an alkyl group having from 1 to 24 carbon atoms substituted with an amino group, and each of m and n is independently an integer of 1 or more.

<4> The lubricating oil composition for agricultural machines according to any one of <1> to <3>, which has a viscosity index of 180 or more.

According to an embodiment of the present invention, it is possible to provide a lubricating oil composition for agricultural machines having reduced viscous resistance at low temperature (for example, −40 °C. to 0 °C.) and excellent shear stability.

DESCRIPTION OF EMBODIMENTS

Hereinafter, a lubricating oil composition for agricultural machines according to the present disclosure will be described in detail. Although the description described below may be made based on a representative embodiment, the lubricating oil composition for agricultural machines according to the present disclosure is not limited to such an embodiment at all.

In the present disclosure, a numerical range indicated using "to" means a range including numerical values described before and after "to" as a minimum value and a maximum value, respectively.

In numerical ranges described in stages in the present disclosure, an upper limit value or a lower limit value described in one numerical range may be replaced with an upper limit value or a lower limit value of a numerical range described in another stage. In addition, in the numerical range described in the present disclosure, the upper limit value or the lower limit value of the numerical range may be replaced with a value shown in examples.

In the present disclosure, an amount of each component in the composition means, when a plurality of substances corresponding to each component are present in the composition, a total amount of the plurality of substances present in the composition unless otherwise specified.

In the present disclosure, "mass %" and "wt %" are synonymous.

In the present disclosure, a combination of two or more preferred aspects is a more preferred aspect.

In the present disclosure, the term "polyalkyl methacrylate-based" means containing a constituent unit derived from an alkyl ester of methacrylic acid.

In the present disclosure, "JIS" is used as an abbreviation for Japanese Industrial Standards.

In the present disclosure, "JPI" is used as an abbreviation for a standard established by the Japan Petroleum Institute.

The present inventors have found that when a specific base oil contains a polyalkyl methacrylate-based viscosity index improver having a specific weight average molecular weight in a specific ratio, and a kinematic viscosity at 100 °C., a kinematic viscosity reduction rate at 100 °C., and a BF viscosity at −40 °C. are in predetermined ranges, a lubricating oil composition for agricultural machines capable of reducing viscous resistance at low temperature and having excellent shear stability is provided.

That is, the lubricating oil composition for agricultural machines of the present disclosure is a lubricating oil composition for agricultural machines, containing: at least one base oil selected from the group consisting of mineral oil-based base oils and synthetic oil-based base oils; and a polyalkyl methacrylate-based viscosity index improver having a weight average molecular weight of from 20,000 to 80,000, in which a kinematic viscosity at 100 °C. is from 8.00 $mm^2/s$ to 10.00 $mm^2/s$, a kinematic viscosity reduction rate at 100 °C. in an ultrasonic shear stability test is 10.0% or less, and a Brookfield viscosity (hereinafter, referred to as a "BF viscosity") at −40 °C. is 20,000 mPa·s or less.

The reason why the lubricating oil composition for agricultural machines of the present disclosure can reduce viscous resistance at low temperature and has excellent shear stability is presumed to be as follows.

That is, in the lubricating oil composition for agricultural machines of the present disclosure, at least one selected from the group consisting of mineral oil-based base oils and synthetic oil-based base oils having good compatibility with various additive components is selected as the base oil, and a specific polyalkyl methacrylate-based viscosity index improver having excellent shear stability and a relatively low molecular weight is contained in the base oil. As a result, the reason is presumed to be because, while desired shear stability due to the specific polyalkyl methacrylate-based viscosity index improver is obtained, the polyalkyl methacrylate-based viscosity index improver is uniformly mixed in the base oil having good compatibility, whereby a decrease in fluidity at low temperature due to the polyalkyl methacrylate-based viscosity index improver itself is suppressed.

Hereinafter, the lubricating oil composition for agricultural machines (also referred to as a "lubricating oil composition", if appropriate) according to the present disclosure will be described in detail.

<Base Oil>

The lubricating oil composition according to the present disclosure contains at least one base oil (hereinafter, also referred to as "specific base oil") selected from the group consisting of mineral oil-based base oils and synthetic oil-based base oils.

The lubricating oil composition according to the present disclosure contains at least one specific base oil from the viewpoint of additive solubility.

The lubricating oil composition according to the present disclosure may contain, as the specific base oil, single one selected from the mineral oil-based base oils and the synthetic oil-based base oils, or may contain a mixed oil obtained by combining two or more selected from the mineral oil-based base oils and the synthetic oil-based base oils.

The specific base oil is not particularly limited as long as it is included in any of the mineral oil-based base oils and the synthetic oil-based base oils, and can be selected from the mineral oil-based base oils and the synthetic oil-based base oils obtained by various production methods. From the viewpoint of additive solubility, the specific base oil is preferably one or more selected from the mineral oil-based base oils.

Examples of the mineral oil-based base oil include those obtained by various production methods.

For example, a highly refined paraffin-based mineral oil obtained by subjecting a hydrogenated refined oil, a catalytic isomerized oil or the like to a treatment such as solvent dewaxing or hydrogenation dewaxing is preferred.

Examples of the hydrogenated refined oil include raffinate obtained by refining the base oil as a raw material using an aromatic extraction solvent such as phenol or furfural, and hydrogenated oil obtained by hydrogenating the base oil using a hydrogenation catalyst such as cobalt or molybdenum using silica-alumina as a carrier. In particular, examples of the mineral oil-based base oil in the present disclosure include, as a suitable base oil, a hydrogenated refined oil that is obtained by a hydrocracking step or an isomerization step and exhibits a high viscosity index (specifically, 110 or more).

Examples of the synthetic oil-based base oil include base oils synthesized by a Fischer-Tropsch reaction using a gas such as methane as the raw material, poly-α-olefin oligomers, polybutenes, alkylbenzenes, polyol esters, polyglycol esters, polyethylene propylenes, hindered esters, and dibasic acid esters.

The lubricating oil composition according to the present disclosure preferably contains only a specific base oil as the base oil.

The content of the specific base oil is not particularly limited as long as it functions as the base oil. For example, the content can be from 30 mass % to 99.9 mass % with respect to a total amount of the lubricating oil composition.

The kinematic viscosity of the base oil at 100 °C. is preferably from 2.00 $mm^2/s$ to 8.00 $mm^2/s$, more preferably from 3.00 $mm^2/s$ to 7.00 $mm^2/s$, and still more preferably from 4.00 $mm^2/s$ to 7.00 $mm^2/s$.

The viscosity index of the base oil is preferably 110 or more, and more preferably 120 or more.

In the present disclosure, the kinematic viscosity of the base oil is a value measured according to JIS K2283 (2000).

Even when the base oil is a mixed oil, the kinematic viscosity at 100 °C. is checked according to JIS K2283 (2000).

In the present disclosure, the viscosity index of the base oil is a value measured according to JIS K2283 (2000). Even when the base oil is a mixed oil, the viscosity index is checked according to JIS K2283 (2000).

When a catalog value can be checked for the kinematic viscosity and/or the viscosity index of the base oil, the catalog value is adopted.

When the kinematic viscosity at 100 °C. and the viscosity index of the base oil are within the above ranges, the viscous resistance at low temperature tends to be reduced.

<Viscosity Index Improver>

The lubricating oil composition according to the present disclosure contains a polyalkyl methacrylate (PMA)-based viscosity index improver (hereinafter, also referred to as a "specific PMA-based viscosity index improver") having a weight average molecular weight (in terms of polystyrene: Mw) of from 20,000 to 80,000.

In the present disclosure, the weight average molecular weight is a molecular weight in terms of standard polystyrene for molecular weight calculation measured by gel permeation chromatography (GPC).

The specific PMA-based viscosity index improver has a weight average molecular weight (in terms of polystyrene: Mw) of from 20,000 to 80,000, preferably from 25,000 to 75,000, and more preferably from 30,000 to 70,000.

By setting the weight average molecular weight (in terms of polystyrene: Mw) of the specific PMA-based viscosity index improver to 20,000 or more, a viscosity index improving effect required for the lubricating oil composition for agricultural machines can be obtained. In addition, by setting the weight average molecular weight (in terms of polystyrene: Mw) to 80,000 or less, it is stable in an initial and long term against shearing applied from a machine.

The specific PMA-based viscosity index improver may be a dispersion type PMA-based viscosity index improver or a non-dispersion type PMA-based viscosity index improver.

In the present disclosure, the viscosity index improver being "dispersion type" means having a polar group such as an amino group or an amide group (preferably having the polar group in a side chain), and being "non-dispersion type" means not having the polar group.

Here, a main chain means a bonding chain that serves as a trunk and is relatively longest among chain parts in a polymer. The side chain means a chain that binds to the main chain of the polymer.

One of the preferred aspects of the specific PMA-based viscosity index improver is a polyalkyl methacrylate (hereinafter, also referred to as a "polyalkyl methacrylate (1)") having a constituent unit represented by the following formula (Ia) and a constituent unit represented by the following formula (Ib).

The polyalkyl methacrylate (1) is an aspect of a dispersion type specific PMA-based viscosity index improver having a weight average molecular weight (in terms of polystyrene: Mw) in the range of from 20,000 to 80,000.

(Ia)

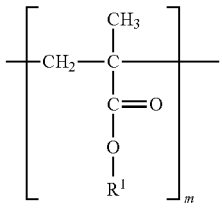

(Ib)

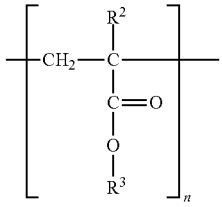

In formulae (Ia) and (Ib), $R^1$ represents a hydrogen atom or an alkyl group having from 1 to 24 carbon atoms, $R^2$ represents a hydrogen atom or a methyl group, $R^3$ represents an alkyl group having from 1 to 24 carbon atoms substituted with an amino group, and each of m and n is independently an integer of 1 or more.

The polyalkyl methacrylate (1) may be a random copolymer or a block copolymer.

In formula (Ib), the amino group substituted for the alkyl group having 1 to 24 carbon atoms is not particularly limited in $R^3$, and may be any of a primary amino group, a secondary amino group, or a tertiary amino group. Preferred examples of the amino group include tertiary amino groups such as a dimethylamino group and a diethylamino group.

One of the preferred aspects of the specific PMA-based viscosity index improver is a polyalkyl methacrylate (hereinafter, also referred to as a "polyalkyl methacrylate (2)") having a constituent unit represented by the following formula (Ic) and having no polar group. The polyalkyl methacrylate (2) is an aspect of a non-dispersion type specific PMA-based viscosity index improver having a weight average molecular weight (in terms of polystyrene: Mw) in the range of from 20,000 to 80,000.

(Ic)

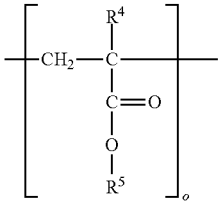

In formula (Ic), $R^4$ represents a hydrogen atom or a methyl group, $R^5$ represents a hydrogen atom or an alkyl group having 1 to 24 carbon atoms, and o is an integer of 1 or more.

In the lubricating oil composition according to the present disclosure, the content of the specific PMA-based viscosity index improver is preferably from 10 mass % to 18 mass %, more preferably from 11 mass % to 16 mass %, and still more preferably from 12.5 mass % to 15 mass % with respect to the total amount of the composition.

When the content of the specific PMA-based viscosity index improver is within the above range, the viscous resistance at low temperature tends to be further reduced and the shear stability tends to be more excellent.

The specific PMA-based viscosity index improver may be a synthetic product or a commercially available product.

The lubricating oil composition for agricultural machines according to the present disclosure may contain only one specific PMA-based viscosity index improver, or may contain two or more specific PMA-based viscosity index improvers.

When the specific PMA-based viscosity index improver is mixed with the base oil, the specific PMA-based viscosity index improver may be mixed as it is or may be mixed as dilution contained in a diluent oil.

In an embodiment, the lubricating oil composition according to the present disclosure preferably contains a hydrogenated refined oil which is a mineral oil-based base oil, and a dispersion type polyalkyl methacrylate (1), and more preferably contains a hydrogenated refined oil having a kinematic viscosity at 100 °C. of from 2.00 $mm^2/s$ to 8.00 $mm^2/s$ (preferably from 3.00 $mm^2/s$ to 7.00 $mm^2/s$, more preferably from 4.00 $mm^2/s$ to 7.00 $mm^2/s$) and a viscosity index of 110 or more (preferably 120 or more), and the polyalkyl methacrylate (1).

Containing the hydrogenated refined oil and the polyalkyl methacrylate (1) is preferred because the viscous resistance at low temperature (for example, −40 °C. to 0 °C.) can be reduced.

<Metal-Based Detergent>

The lubricating oil composition according to the present disclosure may further contain a metal-based detergent.

When the lubricating oil composition contains the metal-based detergent, friction characteristics of constituent members (for example, a wet clutch) of the agricultural machine are further improved.

Examples of the metal-based detergent include alkaline earth metal salts such as alkaline earth metal sulfonates, alkaline earth metal phenates, and alkaline earth metal salicylates.

From the viewpoint of imparting friction characteristics required for the constituent members (for example, the wet clutch) of the agricultural machine, the alkaline earth metal sulfonate is suitably exemplified as the metal-based detergent.

The alkaline earth metal contained in the metal-based detergent is not particularly limited, and examples thereof include calcium, sodium, and barium. Among them, calcium is suitable as the alkaline earth metal. The metal-based detergent is preferably an alkaline earth metal salt overbased with carbonic acid or boric acid.

The base value of the metal-based detergent is preferably from 150 mgKOH/g to 500 mgKOH/g, more preferably from 200 mgKOH/g to 450 mgKOH/g, and still more preferably from 250 mgKOH/g to 450 mgKOH/g in a base value according to a perchloric acid method of JIS K2501 (2003).

The metal-based detergent may be used alone or in combination of two or more.

The content of the metal-based detergent is preferably from 0.05 mass % to 0.50 mass %, and more preferably from 0.15 mass % to 0.45 mass % with respect to the total amount of the composition, as an amount of metal (specifically, an amount of alkaline earth metal).

When the content of the metal-based detergent is in the above range with respect to the total amount of the composition, good friction characteristics tend to be obtained.

<Other Additives>

The lubricating oil composition according to the present disclosure may contain a known additive if necessary in addition to the components described above. Examples of the known additive include friction modifiers, anti-wear agents, oily agents, extreme pressure agents, rust inhibitors, ashless dispersants, antioxidants, pour point depressants, antifoaming agents, colorants, hydraulic oil package additives for agricultural machines, and various package additives for lubricating oils containing at least one of these additives.

In addition, one additive may exhibit two or more functions.

Note that the package additive refers to a mixture of two or more kinds of additives.

Examples of the friction modifier include an organic molybdenum compound, a polyhydric alcohol partial ester compound, an amine compound, an amide compound, an ether compound, a sulfurized ester, a phosphoric acid ester, and a diol compound.

Examples of the anti-wear agent include a dithiophosphoric acid metal salt, a thiophosphoric acid metal salt, a sulfur compound, a phosphoric acid ester, a phosphorous acid ester, an acidic phosphoric acid ester, and an amine salt thereof.

Examples of the oily agent include oleic acid, stearic acid, higher alcohols, amine compounds, amide compounds, sulfurized fats and oils, acidic phosphoric acid esters, and acidic phosphorous acid esters.

Examples of the extreme pressure agent include hydrocarbon sulfide, sulfurized fats and oils, phosphoric acid ester, phosphorous acid ester, chlorinated paraffin, and chlorinated diphenyl.

Examples of the rust inhibitor include carboxylic acids and amine salts thereof, ester compounds, sulfonate salts, and boron compounds.

Examples of the ashless dispersant include succinimide having a polyalkenyl group and a boron derivative thereof.

Examples of the antioxidant include an amine compound, a phenol compound, and a sulfur compound.

Examples of a metal deactivator include benzotriazole, thiadiazole, and alkenyl succinate.

Examples of the pour point depressant include polyalkyl methacrylate, chlorinated paraffin-naphthalene condensate, and alkylated polystyrene.

Examples of the antifoaming agent include silicone compounds such as dimethylpolysiloxane, fluorosilicone compounds, and ester compounds.

<Physical Properties of Lubricating Oil Composition>

The lubricating oil composition according to the present disclosure has a kinematic viscosity at 100 °C. of from 8.00 $mm^2/s$ to 10.00 $mm^2/s$, a kinematic viscosity reduction rate at 100 °C. by the ultrasonic shear stability test of 10.0% or less, and a BF viscosity at −40 °C. of 20,000 mPa·s or less.

The lubricating oil composition according to the present disclosure satisfies all of the kinematic viscosity, the kinematic viscosity reduction rate, and the BF viscosity, and thus is excellent in both reduction of viscous resistance at low temperature (for example, −40 °C. to 0 °C.) and shear stability.

In addition, the lubricating oil composition according to the present disclosure preferably has a viscosity index of 180 or more from the viewpoint of reducing viscous resistance at low temperature (for example, −40 °C. to 0 °C.).

Hereinafter, the kinematic viscosity, the kinematic viscosity reduction rate, the BF viscosity at −40 °C., and the viscosity index exhibited by the lubricating oil composition according to the present disclosure will be described.

[Kinematic Viscosity]

The lubricating oil composition according to the present disclosure preferably has a kinematic viscosity at 100 °C. of from 8.00 $mm^2/s$ to 10.00 $mm^2/s$, more preferably from 8.50 $mm^2/s$ to 9.70 $mm^2/s$, and still more preferably from 9.00 $mm^2/s$ to 9.50 $mm^2/s$ from the viewpoint of extreme pressure performance and appropriate operation as a hydraulic operating oil.

The lubricating oil composition according to the present disclosure preferably has a kinematic viscosity at 40 °C. of from 30.0 $mm^2/s$ to 60.0 $mm^2/s$, more preferably from 35.0 $mm^2/s$ to 55.0 $mm^2/s$, and still more preferably from 40.0 $mm^2/s$ to 50.0 $mm^2/s$.

In the present disclosure, the kinematic viscosity of the lubricating oil composition at 100 °C. is measured according to JIS K2283 (2000).

Adjustment of the kinematic viscosity in the lubricating oil composition can be performed by selection of the base oil, the type and content of the specific PMA-based viscosity index improver, and the like.

[Kinematic Viscosity Reduction Rate]

In the lubricating oil composition according to the present disclosure, the kinematic viscosity reduction rate at 100 °C. in the ultrasonic shear stability test (hereinafter, also simply referred to as the "kinematic viscosity reduction rate") is 10.0% or less, more preferably 9.5% or less, and still more preferably 9.0% or less.

A small value of the kinematic viscosity reduction rate means to be more excellent in shear stability.

The lower limit of the kinematic viscosity reduction rate is not particularly limited and may be 0%. It is realistic that the dynamic viscosity reduction rate of the lubricating oil composition according to the present disclosure is from 1.0% to 10.0%, but the dynamic viscosity reduction rate is not limited to this range.

In the present disclosure, the kinematic viscosity reduction rate of the lubricating oil composition at 100 °C. is measured by the following method in accordance with JPI-5S-29-88.

After 30 mL of standard oil is irradiated with ultrasonic waves for 10 minutes, an output voltage at which the kinematic viscosity reduction rate at 40 °C. is 15% is determined.

For 30 mL of a sample to be measured, the kinematic viscosity at 100 °C. before ultrasonic irradiation (that is, before testing) is measured.

Under the condition of the output voltage obtained above, 30 mL of the sample to be measured is irradiated with ultrasonic waves for 150 minutes, and the kinematic viscosity at 100 °C. of the sample after ultrasonic irradiation (that is, after testing) is measured.

A calculated value obtained by applying measured values of the kinematic viscosity at 100 °C. of the sample before and after testing to the following formula X is rounded off to the first decimal place to obtain the kinematic viscosity reduction rate (%).

Kinematic viscosity reduction rate (%)=[kinematic viscosity at 100 °C. before testing−kinematic viscosity at 100 °C. after testing]/kinematic viscosity at 100 °C. before testing×100 Formula (X):

[BF Viscosity at −40 °C.]

In the lubricating oil composition according to the present disclosure, the BF viscosity is 20,000 mPa·s or less, more preferably 19,000 mPa·s or less, and still more preferably 18,000 mPa·s or less.

In the present disclosure, the BF viscosity at −40 °C. is measured at −40 °C. according to JPI-5 S-26-2010.

[Viscosity Index]

The viscosity index of the lubricating oil composition according to the present disclosure is preferably 180 or more, more preferably 190 or more, and still more preferably 200 or more.

In the present disclosure, the viscosity index of the lubricating oil composition is measured according to JIS K2283 (2000).

—Preparation of Lubricating Oil Composition—

As a method for preparing the lubricating oil composition according to the present disclosure, a specific base oil, a specific PMA-based viscosity index improver, and various additives if necessary may be appropriately mixed. The order of mixing these components is not particularly limited, and these components may be sequentially mixed with the base oil, or various additives may be added to the base oil in advance.

—Application—

The lubricating oil composition according to the present disclosure is used for the agricultural machine.

Examples of the agricultural machine include a tractor as a ground leveling work machine, a rice transplanter as a raising management work machine, a binder or a combine as a harvesting work machine, but are not limited thereto.

EXAMPLES

Next, the lubricating oil composition for agricultural machines of the present disclosure will be described more specifically by examples, but the lubricating oil composition for agricultural machines of the present disclosure is not limited in any way by the examples.

In the examples and comparative examples, a lubricating oil composition was prepared by mixing a base oil, a viscosity index improver, and other additives in blending amounts shown in Tables 1 and 2. Further, the following physical property measurement evaluation was performed using each of the resulting lubricating oil compositions.

In the examples and comparative examples, details of components (that is, the base oil, the viscosity index improver, and other additives) used for preparing the lubricating oil composition are as shown in (A1) to (A4) below.

Further, physical properties (that is, kinematic viscosity, kinematic viscosity reduction rate, BF viscosity, and viscosity index) of the resulting lubricating oil composition were determined by test methods shown in (B1) to (B4) below.

Obtained results are shown in Tables 1 and 2 below.

[Component]

(A1) Base Oil

Base oil A: Hydrogenated refined oil (Mineral oil-based base oil) having a kinematic viscosity at 100 °C. of 5.60 $mm^2/s$ and a viscosity index of 109

Base oil B: Hydrogenated refined oil (Mineral oil-based base oil) having a kinematic viscosity at 100 °C. of 10.80 $mm^2/s$ and a viscosity index of 97

Base oil C: Hydrogenated refined oil (Mineral oil-based base oil) having a kinematic viscosity at 100 °C. of 11.90 $mm^2/s$ and a viscosity index of 108

Base oil D: Hydrogenated refined oil (Mineral oil-based base oil) having a kinematic viscosity at 100 °C. of 4.20 $mm^2/s$ and a viscosity index of 122

Base oil E: Hydrogenated refined oil (Mineral oil-based base oil) having a kinematic viscosity at 100 °C. of 4.20 $mm^2/s$ and a viscosity index of 134

Base oil F: Hydrogenated refined oil (Mineral oil-based base oil) having a kinematic viscosity at 100 °C. of 6.50 $mm^2/s$ and a viscosity index of 131

Base oil G: Hydrogenated refined oil (Mineral oil-based base oil) having a kinematic viscosity at 100 °C. of 3.10 $mm^2/s$ and a viscosity index of 102

(A2) Viscosity Index Improver

Viscosity index improver A: Non-dispersion type polyalkyl methacrylate (weight average molecular weight (Mw): 140,000, amount of active components excluding diluent oil: 50 mass %, product name: ACLUBE 517 (Sanyo Chemical Industries, Ltd.))

Viscosity index improver B: Dispersion type polyalkyl methacrylate (weight average molecular weight (Mw): 47,000, amount of active components excluding diluent oil: 65 mass %)

The viscosity index improver B is a viscosity index improver included in the dispersion type polyalkyl methacrylate (1) which is a specific PMA-based viscosity index improver.

Viscosity index improver C: Non-dispersion type polyalkyl methacrylate (weight average molecular weight (Mw): 35,000, amount of active components excluding diluent oil: 66 mass %)

The viscosity index improver C is a viscosity index improver included in the non-dispersion type polyalkyl methacrylate (2) which is a specific PMA-based viscosity index improver.

(A3) Package Additive

The package additive used in this example is a mixture of the following additives.

Metal-based detergent (overbased calcium sulfonate)

Friction modifier

Amounts of main elements of the package additive are as follows.

Calcium: 6.8 mass %, Sulfur: 3.9 mass %, Nitrogen: 0.02 mass %

(A4) Anti-Wear Agent

Zinc dialkyldithiophosphate (phosphorus concentration: 8.3 mass %)

[Test Method]

(B1) Kinematic Viscosity at 40 °C. and 100 °C.

The kinematic viscosity (unit: $mm^2/s$) at 40 °C. and 100 °C. was measured according to JIS K2283 (2000).

(B2) Viscosity Index

The viscosity index was calculated according to JIS K2283 (2000).

(B3) BF Viscosity (−40 °C.)

The viscosity (mPa·s) at −40 °C. was measured according to JPI-55-26-2010.

(B4) Kinematic Viscosity Reduction Rate (100 °C.)

The shear stability test (ultrasonic shear stability test) was performed by the following method in accordance with JPI-5S-29-88, and was calculated from the dynamic viscosity at 100 °C.

After 30 mL of standard oil is irradiated with ultrasonic waves for 10 minutes, the output voltage at which the kinematic viscosity reduction rate at 40 °C. is 15% was determined.

For 30 mL of the sample to be measured, the kinematic viscosity at 100 °C. before ultrasonic irradiation (that is, before the test) was measured.

Under the condition of the output voltage obtained above, 30 mL of the sample to be measured was irradiated with ultrasonic waves for 150 minutes, and the kinematic viscosity at 100 °C. of the sample after ultrasonic irradiation (that is, after the test) was measured.

In the case of irradiation, for safety of a device, irradiation for 150 minutes was made by performing irradiation for 75 minutes twice.

The calculated value obtained by applying measured values of the kinematic viscosity at 100 °C. of the sample before and after the test to the following formula X was rounded off to the first decimal place to obtain the kinematic viscosity reduction rate (%).

Kinematic viscosity reduction rate (%)=[kinematic viscosity at 100 °C. before test−kinematic viscosity at 100 °C. after test]/kinematic viscosity at 100 °C. before test×100 Formula (X):

In Tables 1 and 2 below, "-" in a composition column means that the corresponding component is not contained.

TABLE 1

| | | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|
| Composition | Base oil A [mass %] | 69.8 | — | — | — | — | — | — |
| | Base oil B [mass %] | 21.3 | — | — | — | — | — | — |
| | Base oil C [mass %] | — | 47.4 | 47.5 | 9.9 | — | 27.6 | — |
| | Base oil D [mass %] | — | 43.7 | — | — | — | — | — |
| | Base oil E [mass %] | — | — | 43.6 | 76.3 | 63.2 | — | — |
| | Base oil F [mass %] | — | — | — | — | 23.0 | 62.4 | — |
| | Base oil G [mass %] | — | — | — | — | — | — | 75.0 |
| | Package additive [mass %] | 4.9 | 4.9 | 4.9 | 4.9 | 4.9 | 4.9 | 4.9 |
| | Viscosity index | 3.9 | 3.9 | 3.9 | 8.8 | 8.8 | — | — |

TABLE 1-continued

| | | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|
| | improver A [mass %] | | | | | | | |
| | Viscosity index improver B [mass %] | — | — | — | — | — | 5.0 | 20.0 |
| | Zinc dialkyldithiophosphate [mass %] | 0.1 | 0.1 | 0.1 | 0.1 | 0.1 | 0.1 | 0.1 |
| Physical properties | 40 °C kinematic viscosity [$mm^2/s$] | 56.9 | 52.6 | 52.2s | 38.2 | 37.7 | 57.4 | 39.8 |
| | 100 °C kinematic viscosity [$mm^2/s$] (before shear stability test) | 9.31 | 9.27 | 9.30 | 8.92 | 8.87 | 9.74 | 9.87 |
| | Viscosity index | 145 | 160 | 162 | 225 | 227 | 155 | 247 |
| | −40 °C BF viscosity [mPas] | 198400 | 55900 | 45700 | 11340 | 10660 | 84280 | 10060 |
| | 100 °C kinematic viscosity [$mm^2/s$] after shear stability test | 8.31 | 8.19 | 8.20 | 7.21 | 7.08 | 9.62 | 8.87 |
| | 100 °C kinematic viscosity reduction rate [%] after shear stability test | 10.7 | 11.6 | 11.8 | 19.1 | 20.2 | 1.2 | 10.1 |

TABLE 2

| | | Example 1 | Example 2 | Example 3 | Example 4 | Example 5 |
|---|---|---|---|---|---|---|
| Composition | Base oil A [mass %] | — | — | — | — | — |
| | Base oil B [mass %] | — | — | — | — | — |
| | Base oil C [mass %] | — | — | — | — | — |
| | Base oil D [mass %] | 60.1 | 80.0 | — | 59.3 | 57.5 |
| | Base oil E [mass %] | — | — | 80.0 | — | — |
| | Base oil F [mass %] | 22.4 | — | — | 23.2 | 22.5 |
| | Package additive [mass %] | 4.9 | 4.9 | 4.9 | 4.9 | 4.9 |
| | Viscosity index improver A [mass %] | — | — | — | — | — |
| | Viscosity index improver B [mass %] | 12.5 | 15.0 | 15.0 | — | — |
| | Viscosity index improver C [mass %] | | | | 12.5 | 15.0 |
| | Zinc dialkyldithiophosphate [mass %] | 0.1 | 0.1 | 0.1 | 0.1 | 0.1 |
| Physical properties | 40 °C kinematic viscosity [$mm^2/s$] | 41.4 | 41.5 | 41.1 | 41.3 | 46.0 |
| | 100 °C kinematic viscosity [$mm^2/s$] (before shear stability test) | 9.15 | 9.53 | 9.49 | 8.51 | 9.47 |
| | Viscosity index | 212 | 224 | 225 | 190 | 196 |
| | −40 °C BF viscosity [mPa · s] | 16060 | 14100 | 12680 | 16800 | 19200 |
| | 100 °C kinematic viscosity [$mm^2/s$] after shear stability test | 8.39 | 8.69 | 8.67 | 8.34 | 9.10 |
| | 100 °C kinematic viscosity reduction rate [%] after shear stability test | 8.2 | 8.8 | 8.6 | 2.1 | 4.0 |

The following can be seen from Tables 1 and 2.

The lubricating oil compositions of Examples 1 to 5 each contain a specific base oil and a specific PMA-based viscosity index improver (the viscosity index improver B or the viscosity index improver C), and it can be seen that, while the BF viscosity at −40 °C. is 20,000 mPa·s or less, the dynamic viscosity reduction rate at 100 °C. after the shear stability test is 10.0% or less, and both low temperature fluidity and high shear stability are obtained. That the lubricating oil composition has low temperature fluidity means that the viscous resistance at low temperature can be reduced.

On the other hand, Comparative Examples 1 to 5 each contain the viscosity index improver A (Mw: 140,000), and it can be seen that both low temperature fluidity and high shear stability are not obtained.

That is, in Comparative Examples 1 to 3, the kinematic viscosity reduction rate at 100 °C. after the shear stability test is more than 10.0%, the BF viscosity at −40 °C. is also more than 20,000 mPa·s, and it can be seen that Comparative Examples 1 to 3 are inferior in both low temperature fluidity and shear stability. Further, in Comparative Examples 4 and 5, although the BF viscosity at −40 °C. is 20,000 mPa·s or less, the kinematic viscosity reduction rate at 100 °C. after the shear stability test is more than 19.0%, and it can be seen that Comparative Examples 4 and 5 are inferior in shear stability.

Comparative Example 6 contains the viscosity index improver B (specific PMA-based viscosity index improver), and it can be seen that, although it is excellent in shear stability, the BF viscosity at −40 °C. greatly increases, it is inferior in low temperature fluidity, and the viscous resistance at low temperature cannot be reduced.

Comparative Example 7 contains the viscosity index improver B (specific PMA-based viscosity index improver), and it can be seen that, although it has a BF viscosity at −40 °C. of 20,000 mPa·s or less and exhibits low temperature fluidity, it has a kinematic viscosity reduction rate at 100 °C. of more than 10.0% and is inferior in shear stability.

From the above, it was confirmed that the lubricating oil compositions for agricultural machines of the Examples can reduce viscous resistance at low temperature and are excellent in shear stability. Therefore, the lubricating oil compositions for agricultural machines of the Examples can be suitably used for agricultural machines such as tractors and combines.

All documents, patent applications, and technical standards described in this specification are incorporated herein by reference to the same extent as if each individual document, patent application, and technical standard were specifically and individually indicated to be incorporated by reference.

The invention claimed is:

1. A lubricating oil composition for agricultural machines, comprising:

at least one base oil selected from the group consisting of mineral oil-based base oils and synthetic oil-based base oils; and a polyalkyl methacrylate-based viscosity index improver having a weight average molecular weight of from 20,000 to 80,000 and which is present in an amount from 10 mass % to 18 mass % with respect to a total mass of the composition, with the proviso that the lubricating oil composition excludes a polyalkyl methacrylate having a weight average molecular weight above 80,000, wherein:

a kinematic viscosity of the lubricating oil composition at 40 °C. is from 41.1 $mm^2/s$ to 50.0 $mm^2/s$, a kinematic viscosity of the lubricating oil composition at 100 °C. is from 8.00 $mm^2/s$ to 10.00 $mm^2/s$, a kinematic viscosity reduction rate of the lubricating oil composition at 100 °C. in an ultrasonic shear stability test is 10.0% or less, and a Brookfield viscosity of the lubricating oil composition at −40 °C. is 20,000 mPa·s or less.

2. The lubricating oil composition for agricultural machines according to claim 1, wherein the polyalkyl methacrylate-based viscosity index improver is a polyalkyl methacrylate having a constituent unit represented by the following formula (Ia) and a constituent unit represented by the following formula (Ib), (Ia)

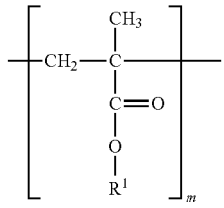

(Ib)

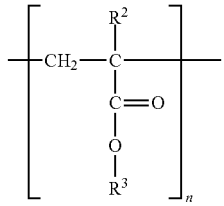

wherein, in formulae (Ia) and (Ib), $R^1$ represents a hydrogen atom or an alkyl group having from 1 to 24 carbon atoms, $R^2$ represents a hydrogen atom or a methyl group, $R^3$ represents an alkyl group having from 1 to 24 carbon atoms substituted with an amino group, and each of m and n is independently an integer of 1 or more.

3. The lubricating oil composition for agricultural machines according to claim 1, which has a viscosity index of 180 or more.

4. The lubricating oil composition of claim 1 wherein the polyalkyl methacrylate-based viscosity index improver has a weight average molecular weight of from 25,000 to 75,000.

* * * * *